United States Patent [19]

Bertetto et al.

[11] 4,083,130

[45] Apr. 11, 1978

[54] PLASTIC SKI BOOT SHELL WITH INTEGRAL CABLE RETAINING STRUCTURE

[75] Inventors: Donald W. Bertetto; Chris A. Hanson, both of Boulder, Colo.

[73] Assignee: Hanson Industries Incorporated, Boulder, Colo.

[21] Appl. No.: 778,752

[22] Filed: Mar. 17, 1977

[51] Int. Cl.[2] ..... A43B 5/04; A43B 21/00; A43B 11/00; A43C 11/00

[52] U.S. Cl. ..... 36/117; 36/50; 36/105; 24/69 SK; 24/70 SK

[58] Field of Search ..... 24/68 SK, 69 SK, 70 SK, 24/71 SK, 73 GC, 81 SK; 36/117, 50, 105

[56] References Cited

U.S. PATENT DOCUMENTS

| | | | |
|---|---|---|---|
| 4,020,571 | 5/1977 | Olivieri | 36/50 |
| 4,037,333 | 7/1977 | Olivieri | 36/50 X |

*Primary Examiner*—Patrick D. Lawson

*Attorney, Agent, or Firm*—Merriam, Marshall & Bicknell

[57] ABSTRACT

A plastic ski boot shell having an opening for foot entry, a buckle on one side of the entry opening for engaging one portion of an endless locking cable, and cable retaining structure on the other side of the entry opening for engaging and retaining another portion of the endless cable. The cable retaining structure is integral with and constitutes a continuation of the shell, the retaining structure being composed of the same plastic material as the shell. The retaining structure permits ready engagement or disengagement of the endless cable.

7 Claims, 9 Drawing Figures

PLASTIC SKI BOOT SHELL WITH INTEGRAL CABLE RETAINING STRUCTURE

BACKGROUND OF THE INVENTION

The present invention relates generally to ski boots and more particularly to plastic ski boot shells having a closure system utilizing an endless cable and a buckle.

Conventionally, in such plastic ski boot shells, there is an elongated opening along the front or the back of the shell to facilitate entry into the shell of a skier's foot. Arranged along one side of the elongated opening are one or more buckles, and, in the conventional plastic ski boot shell, arranged along the other side of the opening, opposite each buckle, is a retainer pad for an endless cable. one portion of the cable is arranged by the retainer pad, and the other portion of the cable is engageable and disengageable with a buckle to lock and unlock the closure system.

Typically, the retainer pads have been fabricated as separate and discrete parts and then assembled onto the plastic ski boot shell utilizing an arrangement which pivotally mounts the retainer pad between a first position for lockingly engaging the endless cable and a second position, rotated 180° from the first position, to permit the removal of the cable from its engagement by the retainer pad. The retaining pad arrangement described in the preceeding sentence is relatively complicated and expensive to manufacture and assemble.

SUMMARY OF THE INVENTION

The present invention provides a cable retaining structure which constitutes an integral continuation of the plastic ski boot shell. This cable retaining structure is capable of engaging or disengaging the endless cable, as required, but it does not require rotation between a plurality of positions in order to do so, nor does it require the relatively complicated mounting necessary to achieve rotation of the retaining structure.

The subject cable retaining structure may be molded integrally with the rest of the plastic ski boot shell, in a single operation, thereby reducing the number of manufacturing operations required as well as the number of separate parts required for fabrication.

Other features and advantages are inherent in the structure claimed and disclosed or will become apparent to those skilled in the art from the following detailed description in conjunction with the accompanying diagramatic drawing.

DETAILED DESCRIPTION

Figure 1:
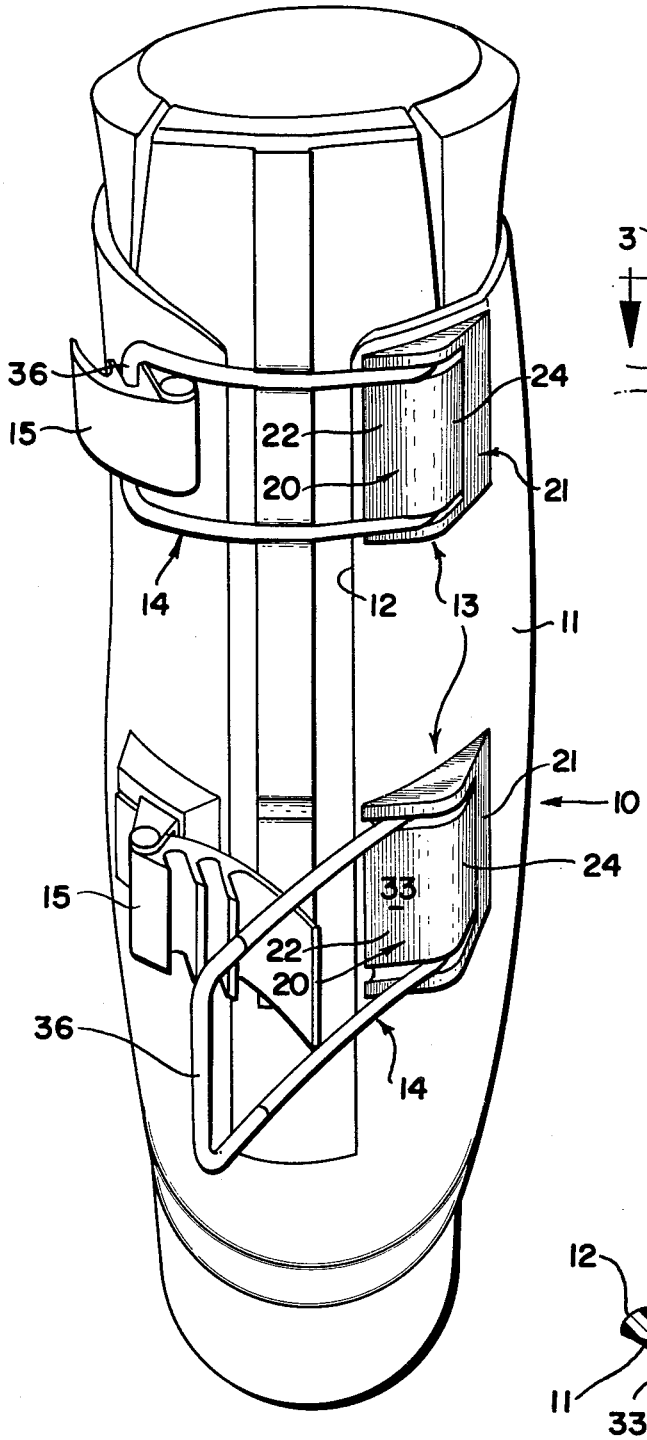
FIG. 1 is a perspective showing the back of a rear entry plastic ski boot employing cable retaining structure in accordance with an embodiment of the present invention.
Figure 2:
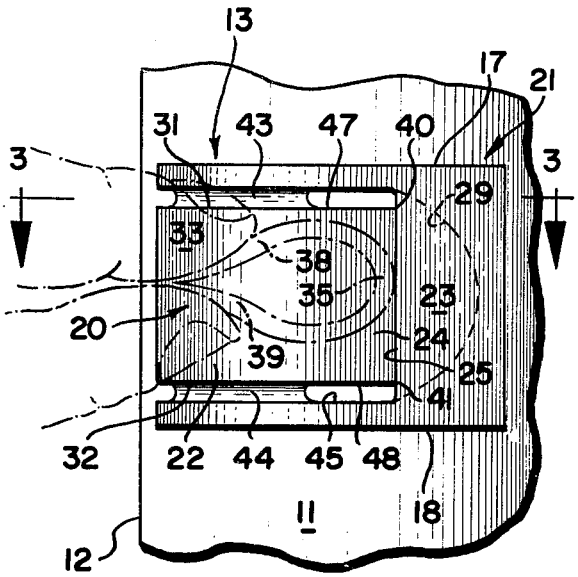
FIG. 2 is a plan view of cable retaining structure in accordance with an embodiment of the present invention.
Figure 3:
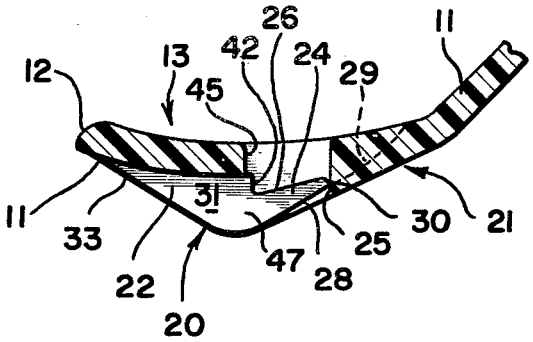
FIG. 3 is a sectional view taken along line 3—3 in FIG. 2.

Referring initially to FIG. 1, indicated generally at 10 is a ski boot of the rear entry type. Boot 10 comprises a plastic shell 11 having an elongated opening 12 at the back of the shell to facilitate entry into the boot of the foot of a skier.

Located along one side of opening 12 are a plurality of cable retaining structures 13, each constructed in accordance with an embodiment of the present invention. Each cable retaining structure 13 engages one portion of an endless cable 14 having another portion engageable by one of a plurality of buckles 15 located along an opposite side of opening 12.

Other than the cable retaining structure described herein, plastic shell 11 may be of conventional construction heretofore utilized for plastic ski boot shells; and, consistent with the features noted below, the shell may be composed of the same plastic material heretofore conventionally utilized for plastic ski boot shells.

Figure 8:
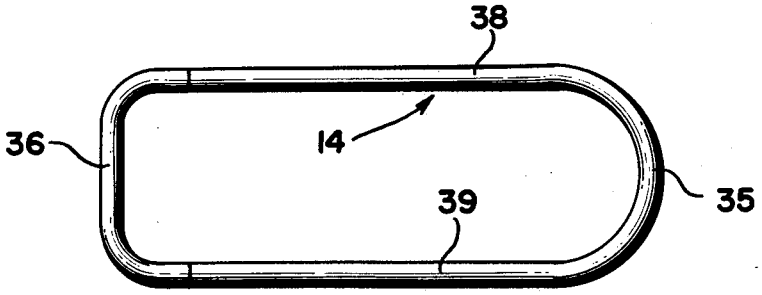
FIG. 8 is a plan view of an embodiment of endless cable used with cable retaining structure in accordance with the present invention.

Referring to FIGS. 1 and 8, each endless cable 14 comprises a relatively flexible bight portion 35 for engagement with retaining structure 13, and a relatively rigid portion 36, connected to flexible bight portion 35, and engageable with a buckle 15.

Cable retaining structure 13 is illustrated in greater detail in FIGS. 2–3 and 6–7.

Each cable retaining structure 13 comprises first and second retainer portions 20, 21 respectively, each aligned with a corresponding buckle 15 and each projecting outwardly from plastic shell 11. First retainer portion 20 is located between its corresponding buckle 15 and second retainer portion 21. Each of the retainer portions 20, 21 is composed of the same plastic as shell 11, and each constitutes an integral continuation of the shell.

Second retainer portion 21 comprises a pair of sides 17, 18 between which is located an outer sloping surface 23 extending from shell 11 and terminating at a surface 25 facing first retainer portion 20. Surface 25 has an opening 27 from which a recess 29 extends in a direction away from first retainer portion 20.

First retainer portion 20 comprises a base part 22 contiguous to shell 11 and a flexible flap part 24 extending from base part 22 toward second retainer portion 21. Flap part 24 has a pair of sides 47, 48 and inner and outer surface 26, 28 converging from base part 22 to an edge 30 adjacent facing surface 25 on second retainer portion 21. Base part 22 comprises a pair of sides 31, 32 between which extends an inclined surface 33 extending outwardly from plastic shell 11.

The plastic of which the retaining structure is composed is sufficiently flexible, and the flap part 24 of the first retainer portion is sufficiently thin to permit some flexing of the flap part. In the unflexed condition, edge 30 on flap part 24 substantially abuts facing surface 25 on second retainer portion 21 near the outer edge 50 on opening 27.

The retaining structure includes a feature which facilitates slipping the arms 38, 39 on the flexible bight portion of cable 14 around the corners 40, 41 at opposite ends of edge 30 on flap part 14. More specifically, edge 30 has a predetermined length. Opening 27 on facing surface 25 of second retainer portion 21 has a dimension, in the same direction as that in which the length of edge 30 is measured, which is slightly greater than the length of edge 30 (see FIGS. 2 and 4), and this facilitates slipping cable 14 around corners 40, 41 on edge 30.

The procedure for passing a cable between edge 30 and second retainer portion 21 is as follows. First, bight portion 35 of the cable is pinched between the thumb and index finger (dash-dot lines in FIG. 2), following which the bight portion is pushed into recess 29 of the second retainer portion while slighty depressing flap part 24 to the extent necessary to permit the cable to enter. Then the pinching action on bight portion 38 is released, and the arms 38, 39 on the bight portion are slipped around corners 40, 41 on flap edge 30.

First retainer portion 20 is cut away at 42, inwardly of the inner surface 26 on flap part 24, to receive and accomodate bight portion 35 of endless cable 14, after the latter has been slipped around the corners of flap edge 30.

Figure 4:
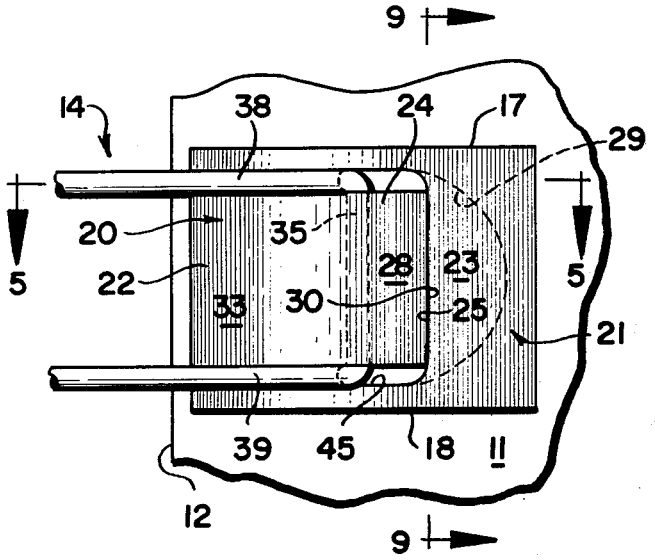
FIG. 4 is a plan view, similar to FIG. 2, showing an endless cable engaged by the cable retaining structure.
Figure 5:
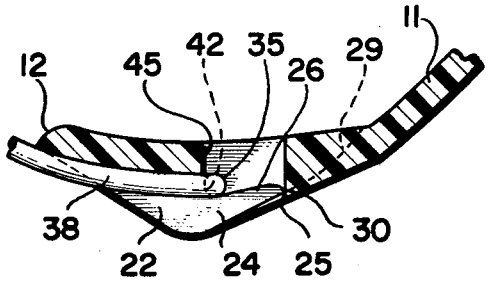
FIG. 5 is a sectional view, similar to FIG. 3, taken along line 5—5 in FIG. 4.
Figure 6:
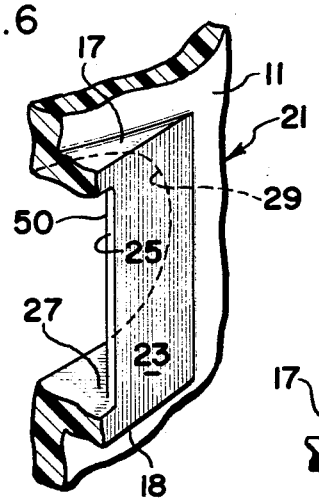
FIG. 6 is a fragmentary perspective of one portion of the cable retaining structure.
Figure 9:
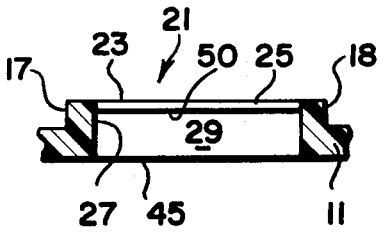
FIG. 9 is an end view of the retainer portion shown in FIG. 6.
Figure 7:
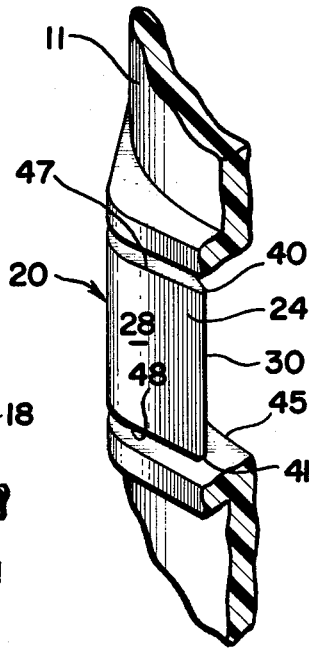
FIG. 7 is a fragmentary perspective of another portion of the cable retaining structure.

To complete the cable-locking operation, rigid portion 36 of the endless cable is then engaged and locked by buckle 15 in a conventional manner, and the engaged, locked endless cable assumes the position illustrated in FIGS. 4 and 5.

As noted above, base part 20 has a pair of opposite sides 31, 32 each of which extends from flap part 24 toward buckle 15. Extending along a respective side 31, 32 are grooves 43, 44 (FIG. 2), each groove comprising means for receiving a respective arm 38, 39, of endless cable 14 when the cable is lockingly engaged by buckle 15 (FIG. 4).

In order to remove cable 14 from its engagement by retaining structure 13, the cable is disengaged from buckle 15 and then merely pulled outwardly against inner surface 26 of flap part 24 at edge 30. The flap part is sufficiently flexible to allow the cable to be pulled between flap edge 30 and surface 25 on second retainer portion 21.

Flexible bight portion 35 of the endless cable may be composed of strands of wire twisted together and coated with a plastic material, a conventional feature of endless cables for plastic ski boots. Rigid portion 36 of the endless cable may be composed of tubular metal.

As shown in FIGS. 2–5, shell 11 has an opening 45 underlying flap part 24 on first retainer portion 20 and at least a part of second retainer portion 21. Opening 45 is in communication with and constitutes a continuation of recess 29 in second retainer portion 21. Recess 29 has a concave contour along vertical and horizontal cross-sections of the recess (FIGS. 2–6).

Providing an opening 45 on shell 11 facilitates the molding of the retaining structure 13 integrally with shell 11. More specifically, when the two halves of the mold are pulled apart, the provision of opening 45 prevents back-draft, an undesirable drawback which could occur in the absence of opening 45.

The foregoing detailed description has been given for clearness of understanding only, and no unnecessary limitations should be understood therefrom, as modifications will be obvious to those skilled in the art.

What is claimed:

1. In a plastic boot shell having an opening for foot entry and a buckle on one side of said opening for engaging an endless cable, cable retaining structure on the other side of said opening and comprising:

first and second retainer portions each aligned with said buckle and each projecting outwardly from the shell;

each of said retainer portions being composed of the same plastic material as said shell and constituting an integral continuation of the shell;

said first retainer portion being located between said buckle and the second retainer portion;

said second retainer portion having a surface facing the first retainer portion;

said first retainer portion having a base part contiguous to said shell and a flexible flap part extending from said base part toward the second retainer portion;

said flap part having an edge adjacent said facing surface on the second retainer portion;

said second retainer portion having an opening in said facing surface thereof and a recess extending from said opening in a direction away from said first retainer portion;

said first retainer portion being cut away inwardly of the inner surface of said flap part to define means for receiving and accommodating a cable.

2. In a boot shell as receited in claim 1, and comprising:

an opening in said shell underlying said flap part on the first retainer portion.

3. In a boot shell as recited in claim 1 and comprising:

a pair of sides on said base part, each side extending from said flap part toward said buckle;

and a pair of grooves in the surface of said shell, each groove extending along a respective opposite side of said base part;

each groove comprising means for receiving a respective part of said endless cable when said cable is lockingly engaged by said buckle.

4. In a boot shell as recited in claim 1 wherein:

said edge on said flap part has a predetermined length;

and said opening on said facing surface has a dimension in the same direction as that in which the length of said edge is measured, which is greater than said predetermined edge length.

5. In a boot shell as recited in claim 4 and comprising:

an opening in said shell underlying said flap part on the first retainer portion and at least a part of said second retainer portion;

said opening being in communication with and constituting a continuation of said recess in the second retainer portion.

6. In a boot shell as recited in claim 4 wherein:

said recess has a concave contour along vertical and horizontal cross-sections of the recess.

7. In combination with the boot shell recited in claim 1, an endless cable comprising:

a relatively flexible bight portion comprising means for engagement with the base part of said first retainer portion;

and a relatively rigid portion connected to said flexible bight portion and comprising means for engagement with said buckle.

* * * * *